US005957061A

United States Patent [19]

Chang

[11] Patent Number: 5,957,061

[45] Date of Patent: Sep. 28, 1999

[54] BANQUET TABLE

[76] Inventor: Mei-Fang Chang, 4F, No. 10, Alley 78, Lane 182, Sec. 2, Rd., Research-Institute, Taipei, Taiwan

[21] Appl. No.: 09/087,083

[22] Filed: May 29, 1998

[51] Int. Cl.[6] ..... A47B 3/00

[52] U.S. Cl. ..... 108/129; 108/167

[58] Field of Search ..... 108/129, 132, 108/169, 167, 166, 168, 170, 171, 173, 174, 175; 248/291.1

[56] References Cited

U.S. PATENT DOCUMENTS

| | | | |
|---|---|---|---|
| 2,542,394 | 2/1951 | Cohen et al. | 108/132 X |
| 4,341,164 | 7/1982 | Johnson | 108/129 X |
| 4,559,878 | 12/1985 | Colby | 108/129 X |
| 5,284,100 | 2/1994 | Thorn | 108/129 |

*Primary Examiner*—Jose V. Chen

*Attorney, Agent, or Firm*—Ware, Fressola, Van Der Sluys & Adolphson LLP

[57] ABSTRACT

A banquet table including a table surface, upper frames fixedly installed on the bottom side of the table surface, and leg frames which are rotatably connected to the upper frames so as to allow the leg frames to be folded inward and toward the bottom side of the table surface. The table surface can also be formed by two sections for folding. The two-section banquet table also includes a pair of hinges for connecting the upper frames on each table section. The hinges are designed to include two facing pressure resisting sections so that when the table is extended, the pressure of the table is applied on the pressure resisting sections, instead of the connecting pin shafts.

2 Claims, 8 Drawing Sheets

BANQUET TABLE

BACKGROUND OF THE INVENTION

1. Field of the Invention

The present invention is related to an improved structure of a banquet table, especially to a table using the combination of a table surface, supporting upper frames, hinges, and supporting leg frames and having the useful function for being folded, stored when the table is not in use. The table can be fully extended when it is in use. The table can be used as a banquet table, a courtyard table, a computer table, a working table, etc.

2. Description of the Prior Art

The conventional banquet table shown in FIG. 1 includes a table surface 1 which is formed integrally or by two different sections, and a circular supporting frame 2 which is fixedly locked on the bottom side of the table surface 1. While circular table legs 3 are installed within the supporting frame, the table legs are attached to the bottom side of the table surface by retainer rings 4 which are installed on the table surface with locking screws. When the banquet table is not in use, the table legs 3 can be folded in order to reduce the storing area. In a table having a surface formed by two sections to be used as a folding table, simple hinges 5 are used to combine the connecting portions of the circular supporting frame 2 so that the banquet table can be extended to provide a larger surface area. When the table is not in use, the table surface can also be folded in half.

However, the prior-art banquet table has the defects of weak structure as those described in the following:

The installation of the supporting frame is less desirable. Although the circular supporting frames 2 are installed along the table surface, the position for bearing the pressure of the table surface is near the edge of the table. Thus, the circular supporting frame can be easily damaged as the pressure is applied on the edge of the table. Secondly, the table legs 3 and the circular supporting frame 2 are not connected. Instead, the table legs 3 are separately connected to the table surface by four retainer rings 4 which are attached to the table by locking screws. As the table legs are standing on the ground to support the table surface, the pressure from the table surface of the banquet table will concentrate on the four retainer rings 4 and the locking screws. In times the screws will lose their grips and the connection for the table legs will become flimsy.

Lastly, for a foldable two sectional banquet table, the two table surface plates are mainly connected by hinges 5. As shown in FIG. 2, the prior-art hinge 5 has a connecting arm 6 one end of which is connected to the circular supporting frame 2 and the other end connected to another connecting arm 6*a* through a pin 7. When the banquet table is extended, due to the structure and design of the hinges 5 the two-sectional table surfaces will probably collide. Furthermore, since the material of the table surfaces is usually made of soft wood material, the downward pressure of the table surface will damage the pin 7 easily. If an improper pressure is applied on the table, the pin will break by the sheared stress.

SUMMARY OF THE INVENTION

It is the primary objective of the present invention to provide an improved structure of a banquet table, wherein the supporting frames on the bottom side of the table surface are improved so that the pressure from the table surface can be distributed to the supporting frames without damaging them.

It is another objective of the present invention to provide an improved structure of a banquet table so that the structure can be used on a table with a single table surface or a folding table with two table surface sections.

It is yet another objective of the present invention to provide an improved hinge for connecting the two surface sections of a folding table.

An improved structure of a banquet table comprises a table surface, a plurality of upper frames to be installed on the bottom side of the table surface, and two sets of supporting leg frames. The upper frames are used to supporting the bearing force of the table surface. A number of round pin tubes are fixedly attached to the upper frames for rotatably connecting the leg frames to the upper frames so that the leg frames can be folded inward and toward the bottom of the table surface. When the bearing force is applied onto the leg frames, the stress would be evenly distributed on the upper frames and the table surface. If the table surface of the banquet table is designed as a two-sectional structure, then the upper frames on the two table sections are connected with improved connecting hinges. The hinges are characterized in that they include pressure resisting sections so that the pressure on the table will be primarily applied on the pressure resisting sections, instead of the pin shafts that connect the hinges. For that reason, the life of the hinges can be prolonged.

The present invention will be better understood and its numerous objectives and advantages will become apparent to those skilled in the art by referencing to the following drawings in which:

DETAILED DESCRIPTION OF THE PREFERRED EMBODIMENT

Figure 1:
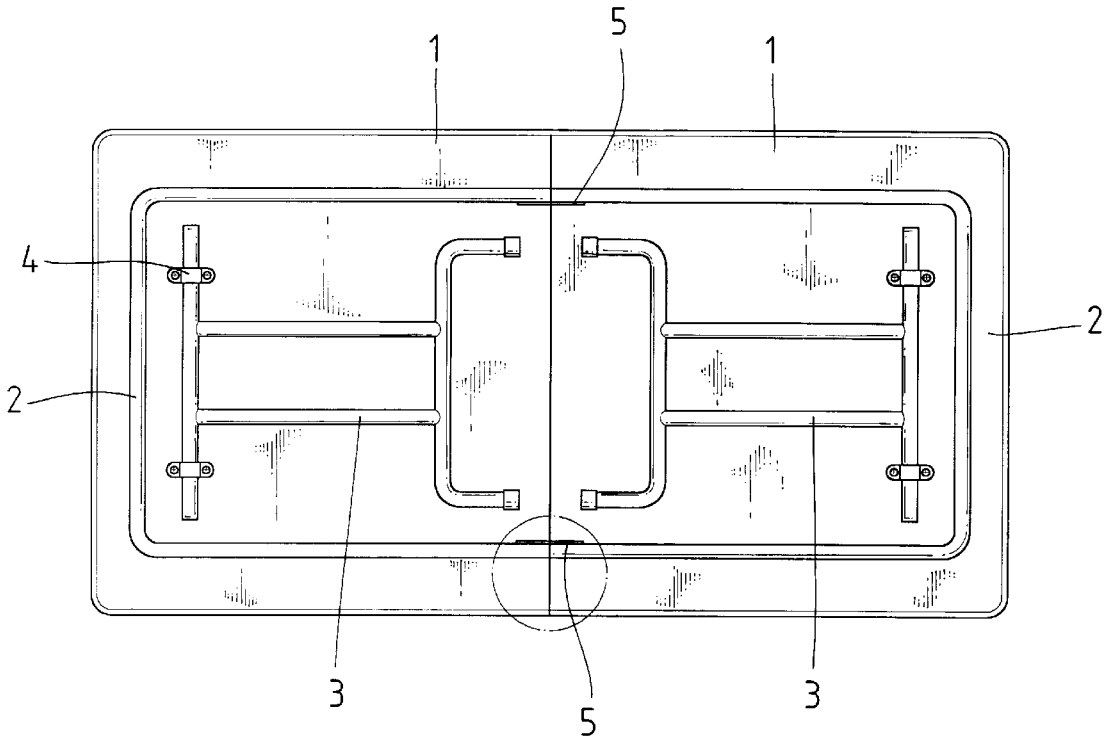
FIG.1 (PRIOR ART)
FIG. 1 is a bottom view of the prior-art banquet table.
Figure 2:
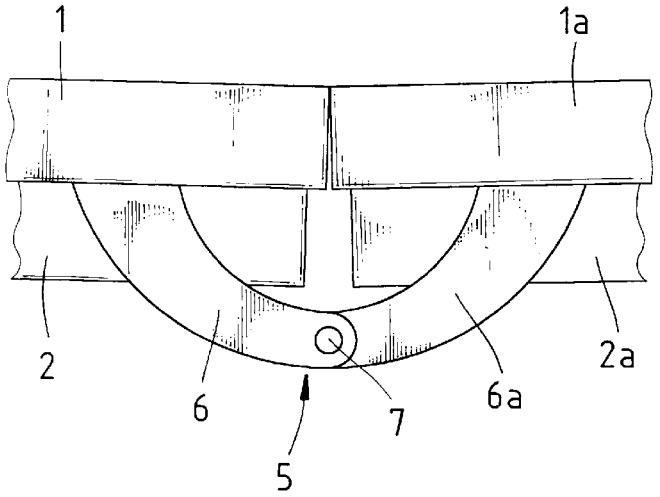
FIG.2 (PRIOR ART)
FIG. 2 is a side view of the hinge of a prior-art banquet table.
Figure 3:
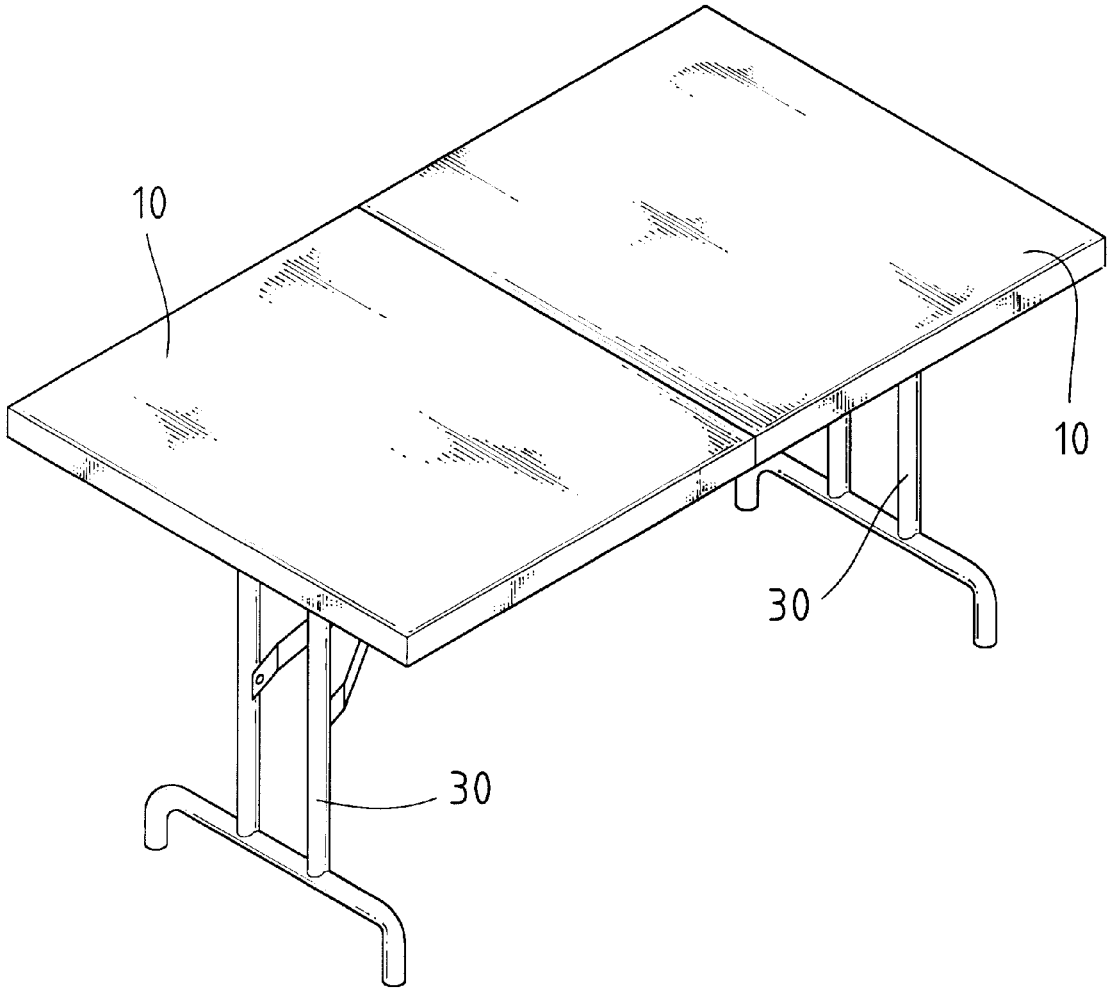
FIG. 3 is a perspective view of the present invention.
Figure 4:
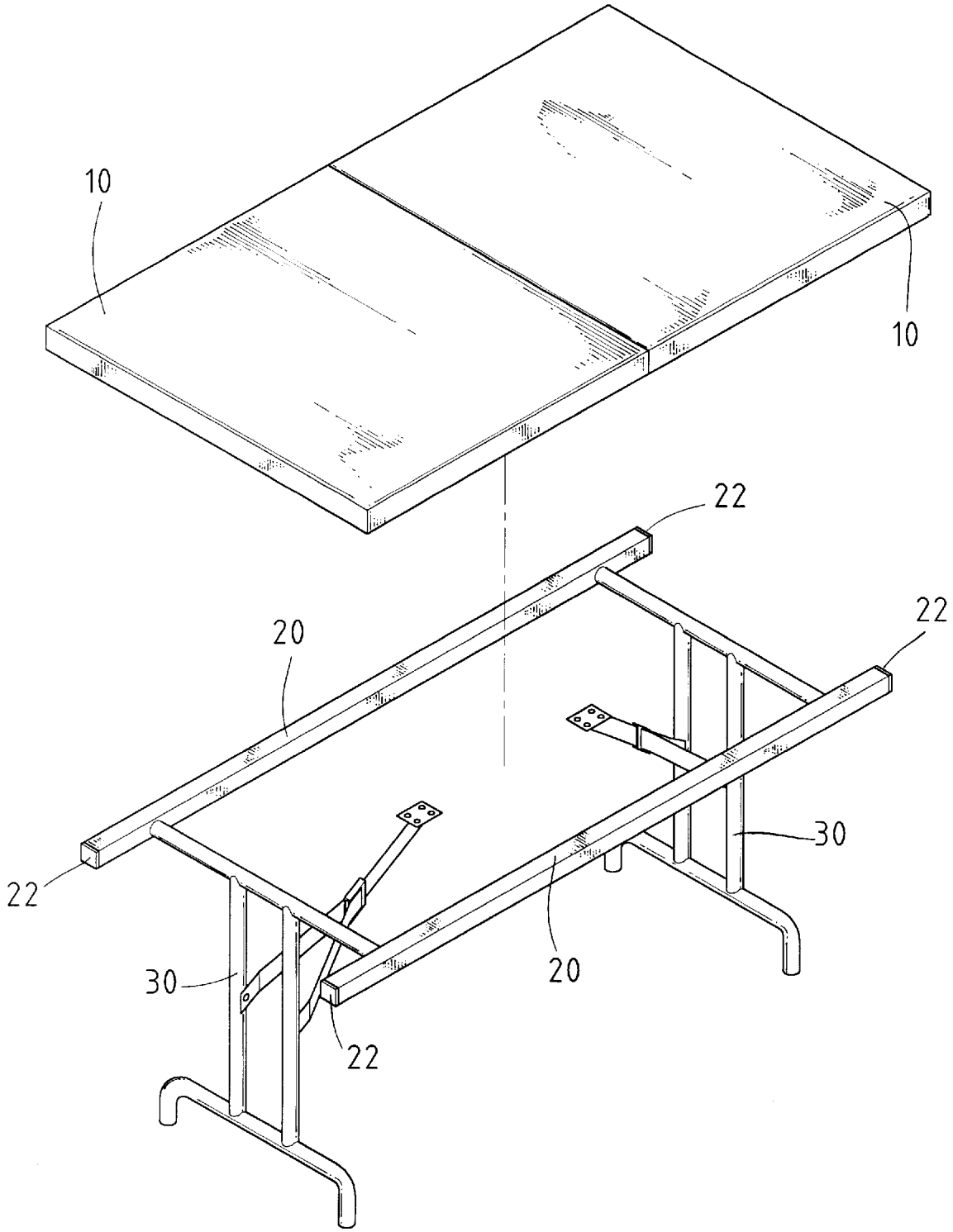
FIG. 4 is an exploded view of the present invention.
Figure 5:
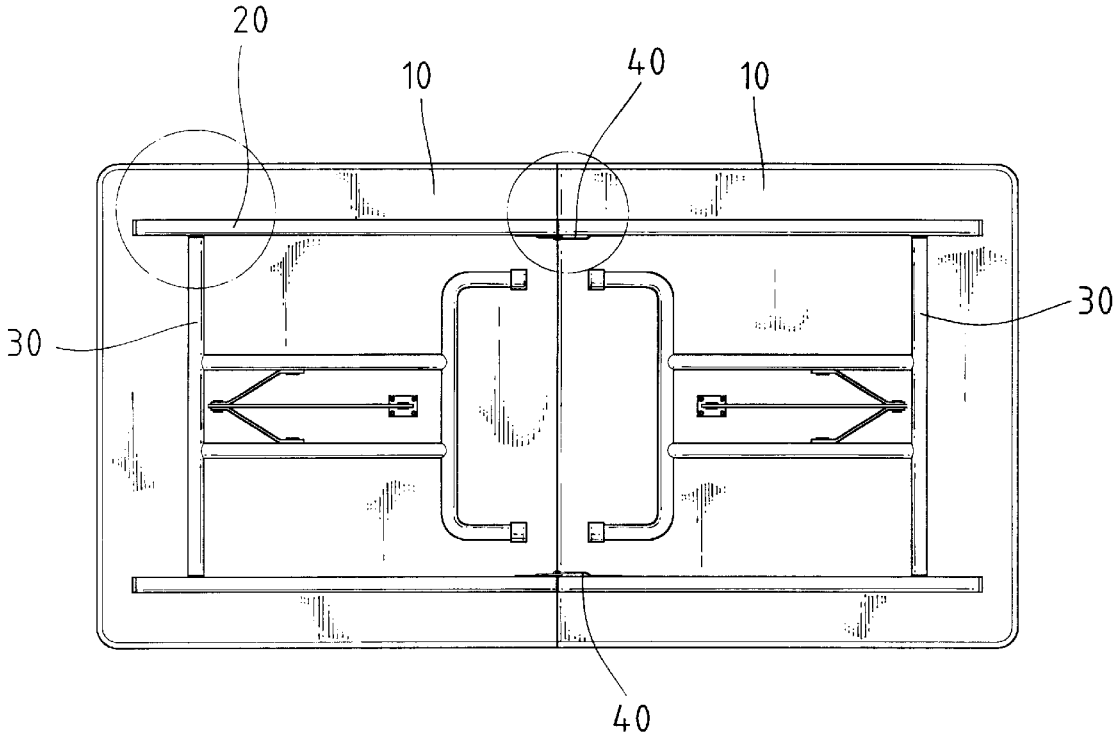
FIG. 5 is a bottom view of the present invention.

Referring to FIGS. 3 to 5, the improved structure of a banquet table of the present invention comprises a table surface 10, at least a plurality of upper frames 20, two sets of leg frames 30. The structure also comprises connecting hinges 40 if the table is designed as a folding table consisting of two surface sections. Preferably, the upper frames are made of rectangular tubing for easy installation. It is understood that the table surface 10 is fixedly connected to the upper frames by screws, rivets, and other connecting elements. The upper frames 20 and the leg frames 30 are pivotably connected through a number of round pin tubes so that the leg frames 30 can be folded inward and toward the bottom of the table surface. In the preferred embodiment of the present invention as shown in the figures, the table surface 10 is designed as a two-sectional foldable type. Accordingly, the upper frames 20 on two table sections are connected with hinges 40 at the folding points.

Figure 6:
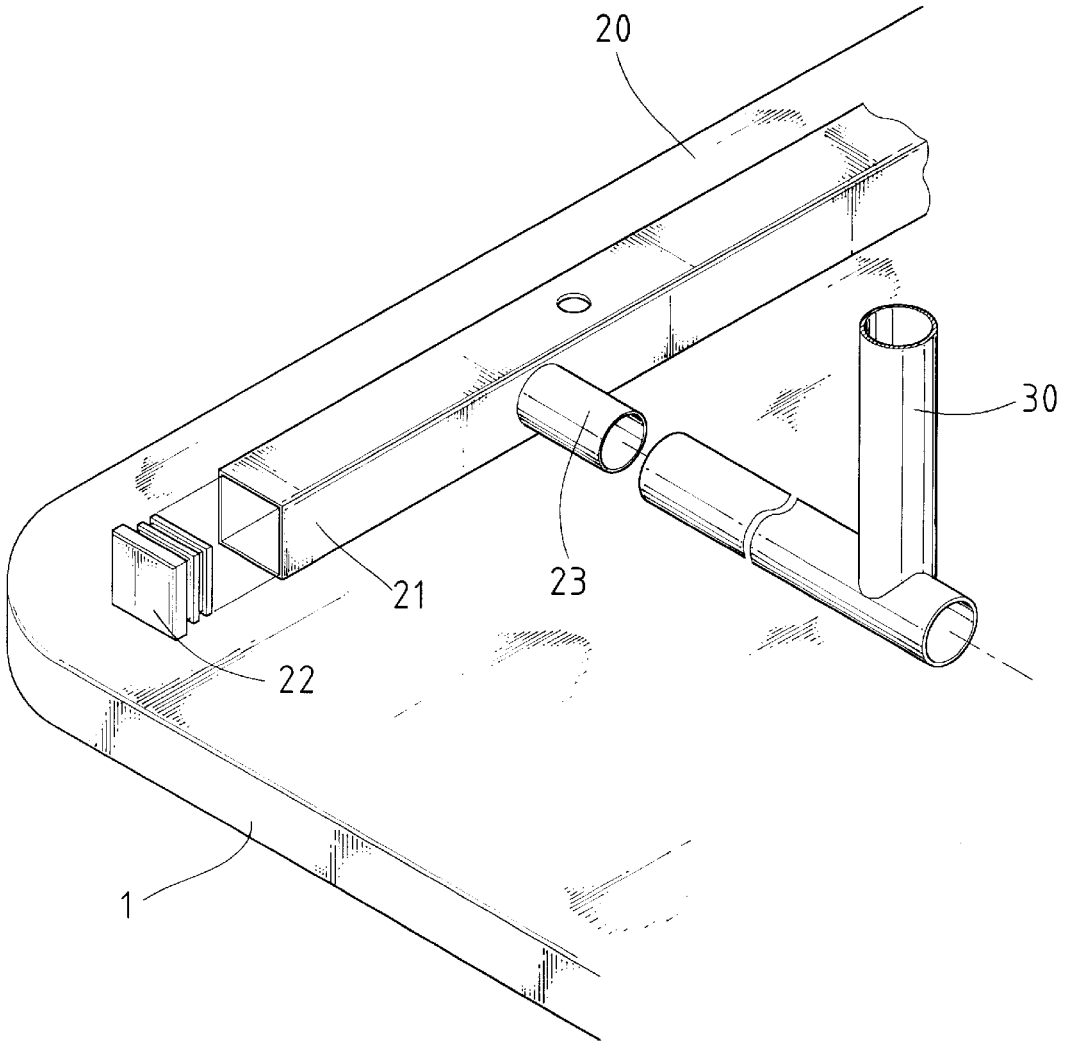
FIG. 6 is a disassembled view of the upper frame and the leg frame of the present invention.
Figure 7:
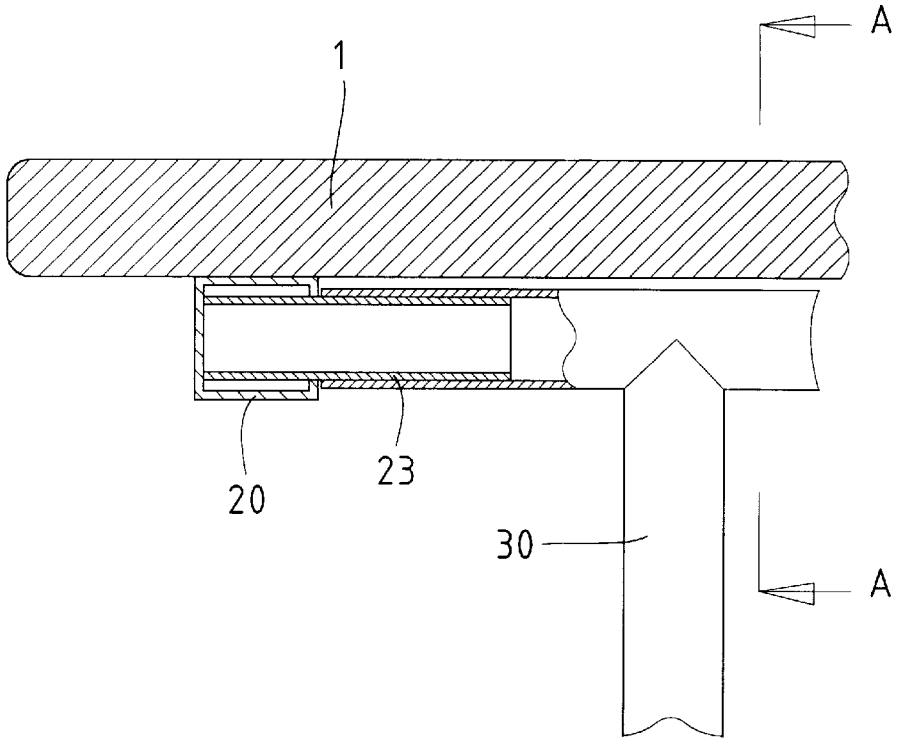
FIG. 7 is an assembled sectional cross section view of the upper frame and the leg frame of the present invention shown in FIG. 6.
Figure 8:
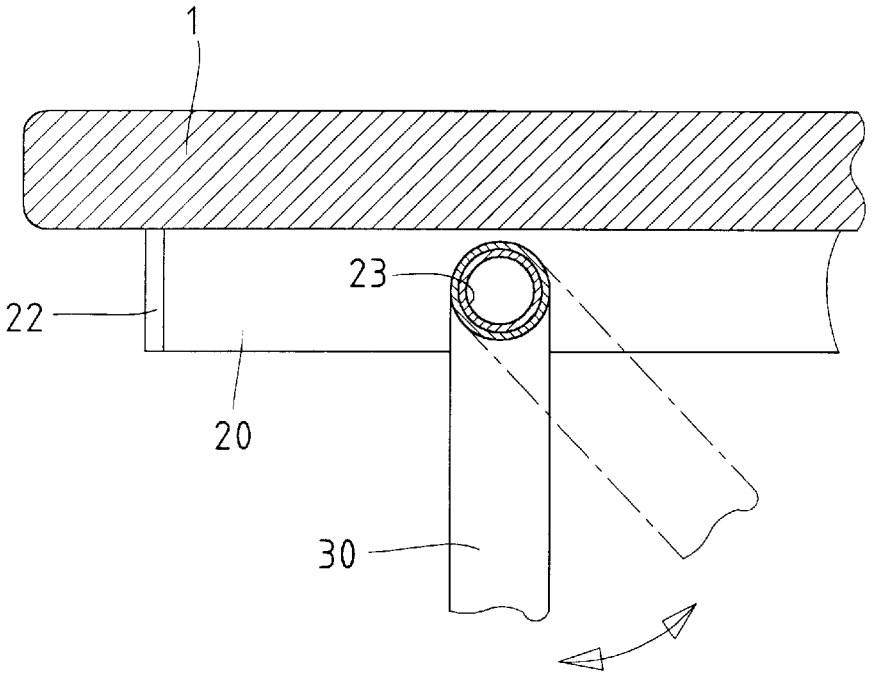
FIG. 8 is a schematic view of the present invention along the line 6A—A.

Referring to FIGS. 6 and 7, the upper frames 20 are fixedly installed under the table surface along the longitudinal edges. A plurality of round pin tubes 23 are fixedly attached onto the upper frames 20 by welding or other means. Each round pin tube 23 is used as a pivot for connecting the leg frame 30 onto the upper frame 20. As shown, the leg frame 30 is constructed with a horizontal bar, a floor support and two connecting bars. The horizontal bar is made from a round tube which has an inner diameter slightly greater than the outer diameter of the round pin tube 23. As the horizontal bar is inserted over the round pin tube 23 on the upper frame 20, the leg frame 30 is rotatably connected to the upper frame 20 so as to allow the leg frame 30 to be folded toward the bottom of the table surface, as shown in FIG. 8. Preferably, each upper frame 20 has extended sections 21 to support the longitudinal ends of the table surface. The end of each extended section 21 can be plugged with a plug 22. As the weight of the table and the contents thereon applies pressure to the upper frames 20, the pressure will be transferred to the supporting leg frames through the round pin tubes. This is a major advantage of the supporting frame structure of the present invention over the prior-art banquet table where pressure is directly applied to the locking screws.

Figure 9:
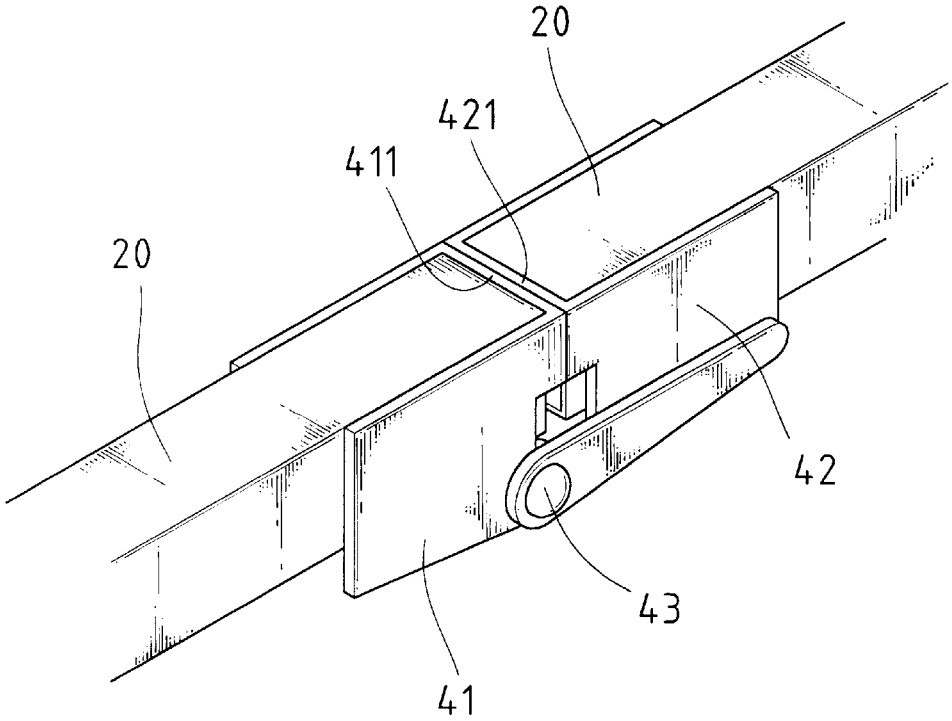
FIG. 9 is a perspective view of the hinge in the present invention.
Figure 10:
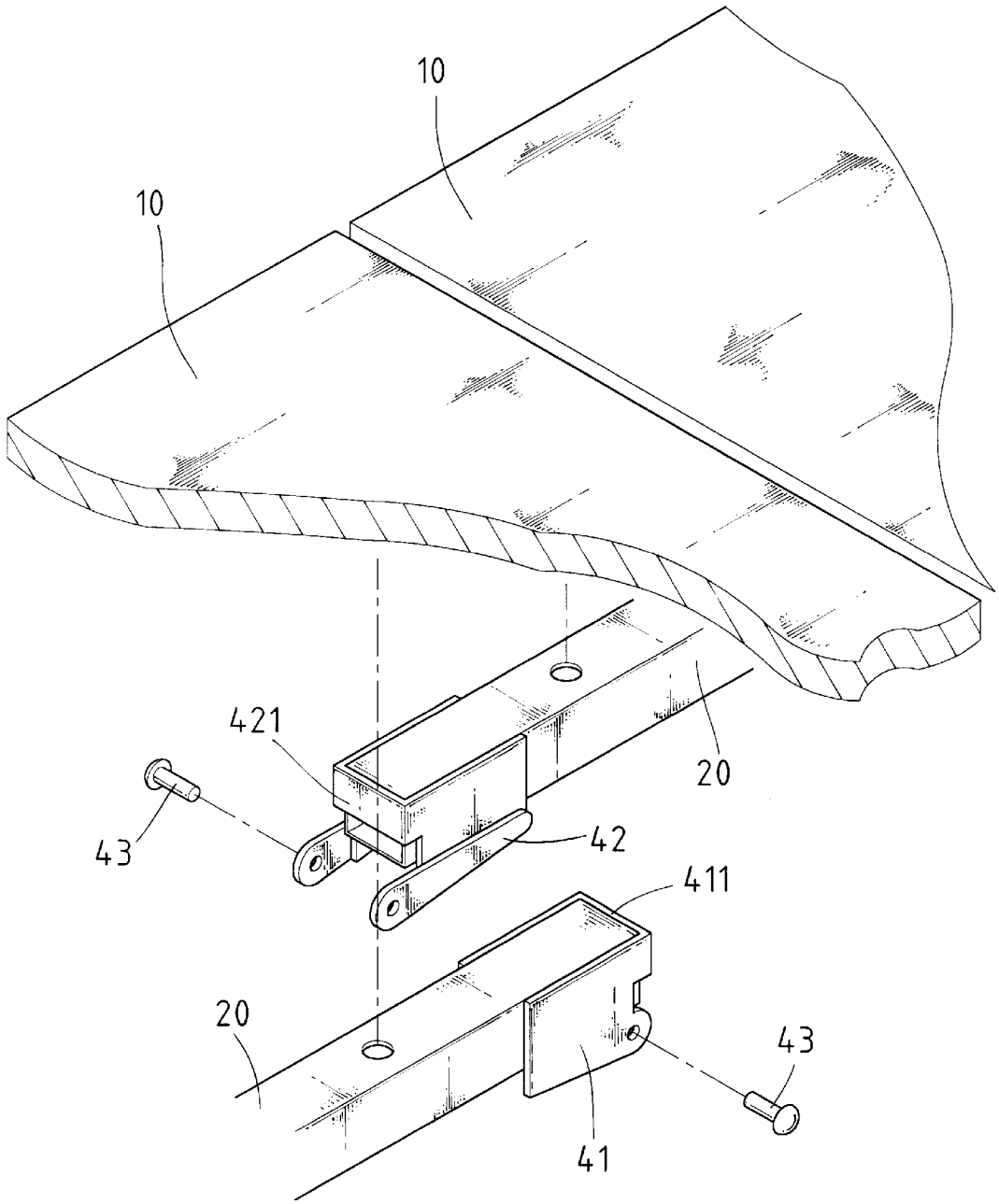
FIG. 10 is a structural exploded view of the hinge in the present invention.

Referring to FIGS. 9 and 10, the upper frames on the two sections of a folding table are connected with a hinge 40 (FIG. 5) at the folding point. The hinge 40 comprises a left bracket 41 and a right bracket 42. The bracket 41 has a pressure resisting section 411 while the bracket 42 has a pressure resisting section 421. The pressure resisting section 421 and the pressure resisting section 411 will be facing each other when the table is in the extended form. The bracket 42 includes a pair of extending arms having a hole in each arm while the bracket 41 has a pair of matching holes so that two brackets can be pivotably connected by pin shafts 43. The design of the hinge 40 allows the pressure to be applied on the pressure resisting sections 411 and 421, instead of the pin shafts 43, when the table is in use. This is another major advantage of the improved structure of the present invention over the prior-art table where pressure is directly applied to the connecting pins on the hinges.

In summary, the improved structure of a banquet table of the present invention has a strong pressure bearing ability, and a simple structure which allows the supporting leg frames to be folded and the table surface to be folded. In addition, it may also be used as a courtyard table, a computer table, a working table and other similar usage.

Although a certain preferred embodiment of the present invention has been disclosed and described in detail, it should be understood that various changes and modification may be made therein without departing from the scope of the appended claims.

What is claimed is:

1. A banquet table comprising a table surface (10), a plurality of upper frames (20) and leg frames (30), wherein the upper frames are fixedly installed on the bottom side of the table surface and the leg frames are pivotably connected to the upper frames by a plurality of round pins (23) so as to allow the leg frames to be folded toward the bottom side of the table surface, wherein said table surface comprises two sections so as to allow said banquet table to be folded when it is not in use and extended when it is in use, said banquet table further comprising a plurality of hinges (40) for connecting the upper frames separately installed on each table section, each of said hinges comprising a first bracket (41) having a first pressure resisting section (411) and a second bracket (42) having a second pressure resisting section (421) facing the first pressure resisting section (411) to absorb pressure when said banquet table is extended, said first bracket (41) further comprising a pair of first holes, said second bracket further comprising a pair of arms, each arm having a second hole matching said first holes for pivotably connecting said first bracket (41) to said second brackets by a pair of pin shafts (43).

2. The banquet table of claim 1 wherein said upper frames are made of rectangular tubing.

* * * * *